United States Patent [19]

Murray

[11] 4,298,119

[45] Nov. 3, 1981

[54] MULTIPLE COMPARTMENT CONTAINERS

[76] Inventor: Michael L. Murray, 425 W. Swallow, Ft. Collins, Colo. 80526

[21] Appl. No.: 111,209

[22] Filed: Jan. 11, 1980

[51] Int. Cl.[3] ..... B65D 79/00

[52] U.S. Cl. ..... 206/219; 206/802; 426/119; 53/483

[58] Field of Search ..... 206/219, 277, 538, 568, 206/528, 540, 802; 215/1, 3; 426/105, 108, 119, 392, 410; 53/370, 483

[56] References Cited

U.S. PATENT DOCUMENTS

| | | | |
|---|---|---|---|
| 2,598,073 | 5/1952 | Rumsey | 53/370 |
| 2,895,475 | 7/1959 | Cole | 206/219 |
| 3,293,048 | 12/1966 | Kitterman | 206/219 |
| 3,478,871 | 11/1969 | Sager | 206/221 |
| 4,223,043 | 9/1980 | Johnson | 426/119 |
| 4,227,614 | 10/1980 | Hollander | 206/219 |

FOREIGN PATENT DOCUMENTS

| | | | |
|---|---|---|---|
| 1408628 | 7/1965 | France | 53/370 |
| 64945 | 6/1942 | Norway | 206/219 |

*Primary Examiner*—Herbert F. Ross

*Attorney, Agent, or Firm*—Hugh H. Drake

[57] ABSTRACT

A multiple-compartment container is formed from an elongated sleeve of flexible material. Opposing end portions of the sleeve are respectively sealed together. A third seal of the walls of the sleeve, at a location spaced between those end portions, defines first and second hollow compartments respectively on each side of that third seal. The third seal is effected by a twisting of the sleeve about its longitudinal axis. There is illustrated a still further and preferred fourth seal at a location spaced between the third seal and one of the end portions so as to define a still further hollow compartment, and that additional seal also is effected by a twisting of the sleeve.

6 Claims, 8 Drawing Figures

MULTIPLE COMPARTMENT CONTAINERS

The present invention pertains to multiple-compartment containers. More particularly, it relates to a lightweight sleeve for separately holding different materials that subsequently are desirably to be mixed within the body of the sleeve and thereafter dispensed therefrom.

In many fields, it often is desirable to transport or store two or more related materials that have to be kept separate until just shortly before the time of use. One example is that of epoxy glue with respect to which appropriate results require that a resin be mixed with a catalyst just prior to application. Often, those two different components have been supplied in separate tubes. The user then mixes a quantity of material from each of the two tubes to form the glue. That must be done just prior to its application by reason of its chemical characteristics.

In a related field, it is sometimes desirable that different components of various medicines be mixed only just prior to usage. For that purpose, the prior art has suggested a number of different dual-compartment containers in which two different components may be kept separately until just prior to application. The following patents are representative of prior art multiple-compartment containers employed for such purposes:

U.S. Pat. No. 1,585,912—Hueblein
U.S. Pat. No. 2,764,983—Barasch et al.
U.S. Pat. No. 3,074,544—Bollmeier et al.
U.S. Pat. No. 3,301,390—Via, Jr.
U.S. Pat. No. 3,596,801—Barnack
U.S. Pat. No. 3,741,383—Wittwer
U.S. Pat. No. 3,756,389—Firth The foregoing prior art represents a trend toward a significant degree of structural complexity in the container itself or in the manner of its formation. As a result, at least some of those containers have not experienced widespread adoption and usage.

It is, accordingly, a principal object of the present invention to provide a new and improved multiple-compartment container that overcomes disadvantages and deficiencies represented in the prior art devices generally intended for the same purpose.

Another object of the present invention is to provide a new and improved container of this kind which is economical of both production and handling.

In accordance with the present invention, a multiple-compartment container includes an elongated sleeve of flexible material. A first sealing together of the walls of one end portion of that sleeve is spaced from a second sealing together of the walls of the other end portion of the sleeve. Also defined is a third sealing together of the walls thereof at a location spaced between the end portions. That third sealing defines first and second hollow compartments respectively on each side thereof. The third sealing is effected by a twisting of the sleeve about its longitudinal axis.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

The multiple-compartment container to be described is formed from an elongated sleeve 10 of a flexible material such as a clear plastic vinyl. The material has a wall thickness sufficient in its strength characteristics to permit the manipulations yet to be described. At the same time, it exhibits the capability of enabling the sealing together of its walls by the application thereto of heat. In itself, such heat sealing or welding of contiguous portions of a sheet plastic material is well known.

Figure 1:
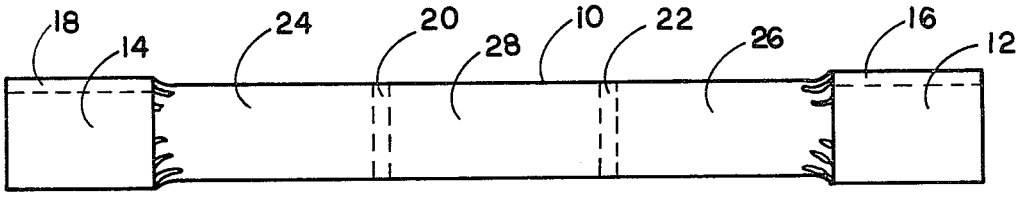
FIG. 1 is a plan view of an elongated sleeve, having sealed end portions, from which the device of the invention is to be formed.
Figure 2:
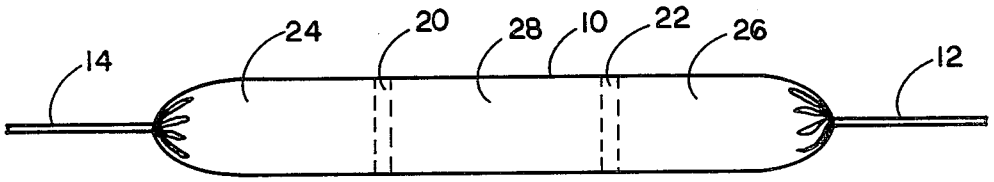
FIG 2 is a side-elevational view of the device of FIG. 1.

As shown in FIGS. 1 and 2, sleeve 10 is heat sealed at its opposite ends to define a first seal in one end portion 12 of the sleeve and a second seal in the other end portion 14 thereof. The walls of end portions 12 and 14 as heat sealed together embrace respective tubes 16 and 18 that individually communicate between the exterior ends of sleeve 10 and the interior thereof beyond end portions 12 and 14. Tubes 16 and 18 are to serve as fill-spouts and in themselves also are formed of a plastic material such as vinyl which exhibits the characteristic of enabling the closure and sealing of the tubes upon the additional application of suitable heat and pressure.

A third seal 20 and a fourth seal 22 also are formed in sleeve 10 at the locations illustrated in FIG. 1. Thus, seal 20 is to be formed at a location spaced between end portions 12 and 14 to define at least first and second hollow compartments 24 and 26. Compartments 24 and 26, therefore, are located respectively on each side of seal 20. At the same time, seal 22 is at a location spaced between seal 20 and end portion 12 so as to define a third hollow compartment 28.

Figure 3:
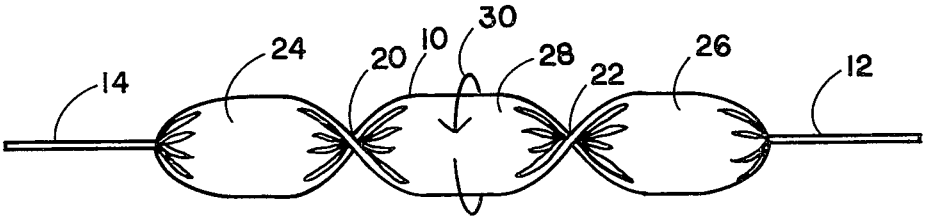
FIG. 3 is a view similar to FIG. 2 but illustrating a degree of further operation upon the device for the purpose of forming multiple compartments.

Seals 20 and 22 each are formed at least primarily by a twisting of sleeve 10 as shown in FIG. 3. In the preferred case as illustrated, in which all three of compartments 24, 26 and 28 are to be formed, that twisting of sleeve 10 about its longitudinal axis is in opposing directions at each of seals 20 and 22 as indicated by arrow 30 in FIG. 3. Consequently, an ultimate pulling apart of end portions 12 and 14 results in a simultaneously untwisting of seals 20 and 22 with a resultant relaxing and separation of those seals.

When desired for convenience of filling as is to be further described, seals 20 and 22 may in themselves first be lightly formed by a continuous circumferential heat seal. However, that seal is purposely of insufficient strength to resist its being separated upon a pulling apart of end portions 12 and 14 at a subsequent time and upon the subsequent untwisting of seals 20 and 22 by the action of pulling upon end portions 12 and 14 so as to cause the untwisting movement.

For use, compartments 24 and 26 are to be filled with respective constituents of a powder, gel, or a liquid which are only later to be mixed together. After the formation of seals 20 and 22, either by the initial formation thereof by light heat sealing as mentioned or after the more durable formation of seals 20 and 22 by effectuation of the twisting as shown in FIG. 3, the respective constituents are inserted through corresponding tubes 16 and 18 after which those tubes are closed by further heat sealing directly thereof.

It will be appreciated that the inclusion of tubes 16 and 18 as fill spouts is optional. In the alternative, end portions 12 and 14 are left open at least in part until after the formation of seals 20 and 22, end portions 12 and 14 being completely sealed in this alternative only after the filling of compartments 24 and 26 with the respective constituents.

In any case, the result of forming and filling operation is the creation of a container as shown in FIG. 3 which includes a complete sealing of end portions 12 and 14 together with full seals 20 and 22 achieved by the effect of the twisting of sleeve 10. Accordingly, the respective constituents are contained in individually and respective compartments 24 and 26, while compartment 28 is empty.

Figure 4:
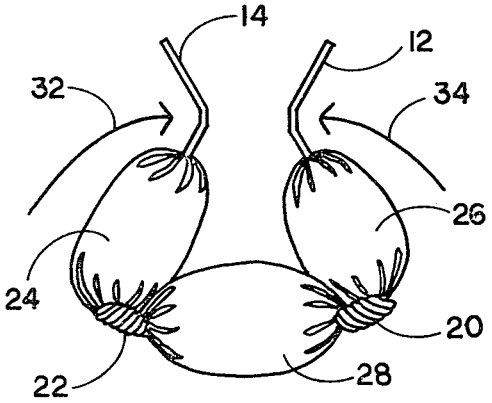
FIG. 4 is a side-elevational view showing a different positioning of various portions of the device of the preceding figures.
Figure 5:
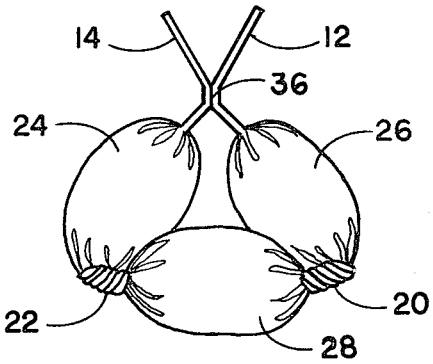
FIG. 5 is a side-elevational view illustrating a finally assembled form of such a device.

For the purpose of ultimate packaging, compartments 24 and 26 are then bent around and toward one another as indicated by arrows 32 and 34 in FIG. 4, so as to force end portions 12 and 14 together and permit their mutual securement by means of the formation of a still additional heat seal 36 as shown in FIG. 5. The resultant package, therefore, is ready for shipment and ultimate delivery to a consumer. Accordingly, the consumer obtains a package in which the respective constituents are kept separate until it is desired that they be mixed.

Figure 6:
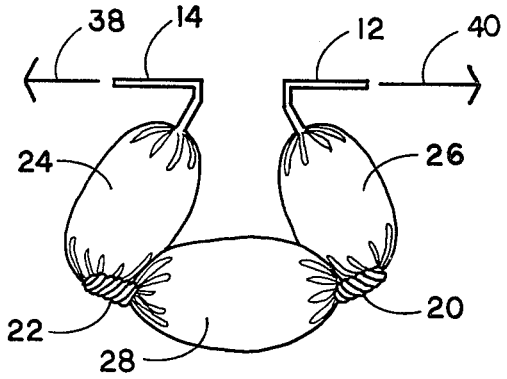
FIG. 6 is a view similar to FIG. 4 but illustrating a slightly different positioning of the different portions thereof during a subsequent mode of manipulation.
Figure 7:
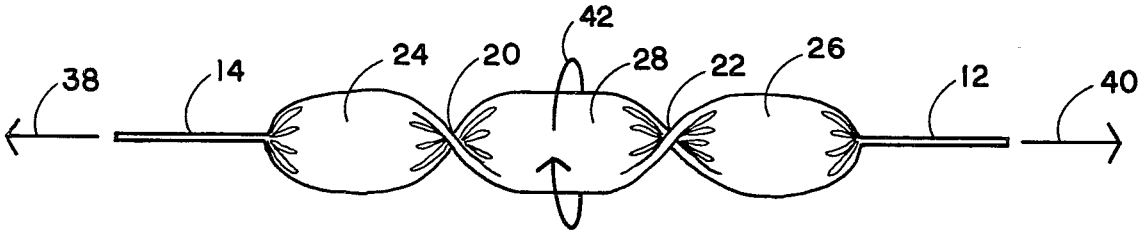
FIG. 7 is a view similar to FIG. 3 but illustrating a reverse mode of manipulation.
Figure 8:
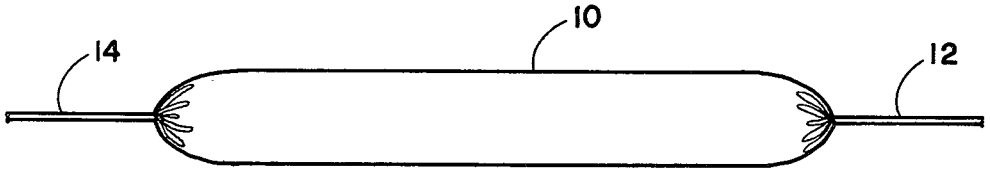
FIG. 8 is a view similar to FIG. 2 but representing the condition of the device following the mode of manipulation represented by FIG. 7.

To accomplish the ultimate mixing, the consumer grasps end portions 12 and 14 and pulls them apart as indicated by arrows 38 and 40 in FIG. 6, thereby breaking heat seal 36. Upon continuing that imposition of opposing forces upon end portions 12 and 14, centermost compartment 28 rotates, relative to compartments 24 and 26, as represented in FIG. 7 by arrow 42. This action relaxes the sealing effected by the twist at seals 20 and 22 as well as separating any light heat sealing effected at seals 20 and 22 as previously mentioned. The consequent end result of the pulling apart of end portions 12 and 14 is the restoration of sleeve 10 to its initial single-compartment form as shown in FIG. 8. Accordingly, the user is then enabled to effect a thorough mixing of the two different constituents, previously retained separately in compartments 24 and 26, simply by kneading and otherwise manipulating the flexible walls of sleeve 10.

Once the mixture of the constituents has been completed, it is only necessary to form any kind of an opening in sleeve 10 for the purpose of dispensing the mixed contents. To that end, the wall of sleeve 10 may be pierced at any point, either one of end portions 12 and 14 may be removed as by cutting or, if they have been included, either one of tubes 16 and 18 may be snipped open interiorly of the heat seal formed therein. In any case, the mixed material thereafter may be delivered to a point of use by the application of hand pressure upon the walls of sleeve 10.

In principle, only separate compartments 24 and 26 need be included, and compartment 28 may be omitted. In that case, only one of seals 20 and 22 would, of course, be included. That approach, however, would not enable the feature of separating the sealing between the separately-stored constituents by a simple pulling apart of end portions 12 and 14. Instead, one of the two compartments and its corresponding end portion would have to be manually untwisted relative to the other. In addition, the preferred provision of the additional "open" compartment 28 allows the formation of an intermediate air pocket capable of safely detecting an undesired leak in one of the two seals 20 and 22. Compartment 28 also affords an additional looseness in sleeve 10 at the time it is returned to its elongated condition as shown in FIG. 8, thereby to facilitate kneading or other manipulation of sleeve 10 for the purpose of obtaining the desired mixing.

Preferably, therefore, all three of compartments 24, 26 and 28 are included. Moreover, it is contemplated that the third compartment may be filled with a third material ultimately to be mixed with the materials respectively in the other two compartments. Still further, additional compartments may be formed in series with the ones shown, so as to permit the separate storage and later mixing of even more constituents.

The container will be observed to have a wide variety of applications and uses. Respective different medicinal components may be separately stored for ultimate mixing only at the time of use. Analogously, the resins and the catalyst of an epoxy glue may similarly be separately stored so as to permit their mixture only just before the desired formation of the glue. Various foodstuffs correspondingly are desired to be kept separate until at least approximately the time of use. An example of the latter would be the storing of a vinegar and oil solution in one compartment and spices in the other. In connection with the separate storage of related foodstuffs, the resulting unit is sufficiently lightweight and yet durable as to be useful to backpackers, campers and similar users. For those purposes, it may be observed that the material employed for the formation of sleeve 10 is such as to be readily burnable, avoiding the need for such users to dispose of bottles, cans or other containers.

While a particular embodiment of the invention has been shown and described, including alternative modifications thereof, it will be obvious to those skilled in the art that changes and further modifications may be made without departing from the invention in its broader aspects. Therefore, the aim in the appended claims is to cover all such changes and modifications as fall within the true spirit and scope of that which is patentable.

I claim:

1. A multiple-compartment container comprising:

an elongated sleeve of flexible, heat-sealable material;

means defining a first heat-sealing together completely of the walls of one end portion of said sleeve;

means defining a second heat-sealing together completely of the walls of the other end portion of said sleeve;

means defining a third sealing together of the walls of said sleeve at a location spaced between said end portions to define first and second hollow compartments respectively on each side of said third sealing, said third sealing being effected by twisting of said sleeve about its longitudinal axis;

and means defining a fourth sealing together of the walls of said sleeve at a location spaced between said third sealing and one of said end portions to define a third hollow compartment disposed between said first and second compartments, said fourth sealing being effected by twisting of said sleeve about its longitudinal axis;

said third and fourth twisted sealings include a continuous circumferential heat seal readily separated upon a pulling apart of said end portions;

said twistings of said third and fourth sealings are in opposite directions so that the pulling apart of said end portions results in simultaneous untwisting of said third and fourth sealings thereby opening into the original elongated sleeve.

2. A container as defined in claim 1 which further includes first and second sealable fill-spouts individually disposed entirely within respective ones of said end portions and communicating respectively with said first and second compartments.

3. A container as defined in claim 2 in which said fill-spouts each are composed of a hollow tube disposed through the corresponding end portion into communication with a respective one of said compartments.

4. A container as defined in claim 1 in which respective segments of said end portions are removably heat sealed together.

5. A container as defined in claim 4 in which said segments are heat sealed together only to a degree sufficient to permit disjoinder thereof without destruction of said first and second sealings.

6. A multiple-compartment container package comprising:

an elongated sleeve of flexible heat-sealable material;

means defining a first sealing together completely of the walls of one end portion of said sleeve;

means defining a second sealing together completely of the walls of the other end portion of said sleeve;

means defining a third sealing together of the walls of said sleeve at a location spaced between said end portions to define first and second hollow compartments respectively on each side of said third sealing, said third sealing being effected by twisting of said sleeve about its longitudinal axis;

means defining a fourth sealing together of the walls of said sleeve at a location spaced between said third sealing and one of said end portions to define a third hollow compartment disposed between said first and second compartments, said fourth sealing being effected by twisting of said sleeve about its longitudinal axis, said third and fourth twisted sealings include a continuous circumferential heat seal readily separated upon a pulling apart of said end portions, said third and fourth twisted sealings being in opposite directions so that the pulling apart of said end portions results in simultaneous untwisting of said third and fourth sealings thereby opening into the original elongated sleeve;

said first and second compartments individually being filled with respective different constituents while said third compartment remains empty with said third and fourth sealings twisted but said constituents being mixable together in all of said compartments upon the untwisting of said third and fourth sealings.

* * * * *